US005080409A

United States Patent [19]

Niswonger

[11] Patent Number: 5,080,409

[45] Date of Patent: Jan. 14, 1992

[54] GARAGE DOOR LOCK ACTUATION MECHANISM

[76] Inventor: John O. Niswonger, 1947 Silver Spur Cir., Ojai, Calif. 93023

[21] Appl. No.: 656,513

[22] Filed: Feb. 19, 1991

[51] Int. Cl.[5] ..... E06B 3/00

[52] U.S. Cl. ..... 292/345; 160/209; 49/506

[58] Field of Search ..... 292/345, DIG. 36, 1; 49/526; 160/113, 209

[56] References Cited

U.S. PATENT DOCUMENTS

| | | | |
|---|---|---|---|
| 2,276,976 | 3/1942 | Howell et al. | 160/209 |
| 2,327,778 | 8/1943 | Ferris et al. | 292/DIG. 36 |
| 4,356,668 | 1/1982 | Wagner | 160/113 |

*Primary Examiner*—Richard E. Moore

*Attorney, Agent, or Firm*—Donald A. Streck

[57] ABSTRACT

A door lock actuating mechanism particularly suited for used with a multi-panel rolling overhead garage door having an automatic opener attached thereto by a connecting bar. The mechanism fits between the connecting bar and the top door panel and a pull cable operating the locking bolt(s) is also connected thereto. There is an attaching member attached to the top panel and a sliding pendulum bar to which the connecting bar and cable are connected. When the door is opened, the pendulum bar slides to an unlocked position where it is latched by the force of gravity thus holding the locking bolt(s) in an unlocked position during door movement. The pendulum bar and locking bolt(s) are only released when the attaching member returns to the vertical position upon door closing.

12 Claims, 5 Drawing Sheets

GARAGE DOOR LOCK ACTUATION MECHANISM

BACKGROUND OF THE INVENTION

This invention relates to locks for garage doors employing an automatic opener and, more particularly, in a rolling overhead garage door having a plurality of horizontal, joined, articulated panels supported for vertical and horizontal movement between closed and open positions, a spring-loaded locking bolt withdrawable by a cable connected thereto, and an automatic opening and closing mechanism connected to a top panel of the door by a connecting bar, to a door lock actuation mechanism which retains the locking bar in a retracted position for an optimum period of door travel away from the closed position comprising, a U-shaped attaching member including means for attaching the attaching member to the top panel, the attaching member having a pair of vertical, parallel, spaced side members, the side members each having a first slot and a second slot disposed opposite the first slot and the second slot of the other of the side members, the first slot being vertically higher at a top end thereof than the second slot, the second slot having a side slot communicating therewith at a top outer end thereof; a pendulum bar disposed between the side members and having first and second spaced bores therethrough adjacent an end thereof along a longitudinal line of the bar;, a first pin disposed through the first bore and the first slot; and, a second pin disposed through the second bore and the second slot; and wherein additionally, spacing between the bores is slightly wider than spacing between the first slot and the second slot whereby the pendulum bar is disposed at a downward acute angle to the top panel; the connecting bar is pivotally connected to the first pin; and, the cable is connected to the first pin whereby the second pin pivots about the first pin into the side slot from the force of gravity on the pendulum bar as the garage door is opened and the attaching member rotates from a vertical to a horizontal position thus holding the locking bolt in a retracted position until the second pin is released from the side slot upon the attaching member returning to the vertical position.

Various mechanisms have been provided over the years for locking garage doors. More recently, with the advent of automatic garage door openers, mechanisms which will automatically lock and unlock the doors in combination with the automatic opening operation have been made available in the art.

The vast majority of garage doors as employed in the garages of homes are overhead doors. Overhead doors usually come in two types—single piece and rolling. A single piece door pivots about pivot points at the sides to move between raised and lowered positions. In my prior patent application Ser. No. 459,557, filed Jan. 2, 1990, now U.S. Pat. No. 4,996,795, I described an improved mechanism for locking and unlocking single piece garage doors which employ an automatic opener.

Rolling doors comprise a plurality of horizontal panels hingedly joined to one another. Each panel is supported on its ends by tracks that smoothly curve from vertical to horizontal at the top of the garage door jamb. The automatic garage door opening mechanism is attached to the top middle of the top-most panel. Thus, when the opening mechanism moves away from the garage door in an opening operation, the top of the door is pulled up and back to move horizontally along the supporting track with the remaining panels following behind. While a single piece garage door is usually locked by bars extending downward from the bottom of the door into holes provided therefor in the garage floor slab to prevent the door from being pried up sufficiently for a small person to slide underneath and gain access to the garage (after which the door can be fully released and raised by disengaging the locking and opening mechanisms), a rolling door is usually locked by means of spring-loaded bolts at the side edges of one of the more central panels engaging holes provided therefore in the supporting track. Since the panels are hingedly joined for combined articulated movement, preventing movement of one panel prevents movement of all panels.

As with the case of my above-referenced patented single piece door locking mechanism which solved problems of prior art locking mechanisms in that environment, present prior art locking mechanisms for rolling overhead garage doors have problems and limitations. Principally, one does not wish to have the spring-loaded locking bars sliding against the track for the majority of the door's movement after being unlocked and prior to re-locking. What is needed is a mechanism which will hold the locking bars in a retracted position until just before they are to engage their locking holes upon door closing.

Wherefore, it is the object of the present invention to provide a door locking mechanism for use on rolling overhead garage doors which will solve their unique locking problems.

Other objects and benefits of the invention will become apparent from the detailed description which follows hereinafter when taken in conjunction with the drawing figures which accompany it.

SUMMARY

The foregoing object has been achieved by in a rolling overhead garage door having a plurality of horizontal, joined, articulated panels supported for vertical and horizontal movement between closed and open positions, a spring-loaded locking bolt withdrawable by a cable connected thereto, and an automatic opening and closing mechanism connected to a top panel of the door by a connecting bar, by the door lock actuation mechanism of the present invention which retains the locking bar in a retracted position for an optimum period of door travel away from the closed position comprising, a U-shaped attaching member including means for attaching the attaching member to the top panel, the attaching member having a pair of vertical, parallel, spaced side members; a pendulum bar disposed between the side members for sliding movement therebetween between a locked position and an unlocked position, the pendulum bar being disposed at a downward acute angle to the top panel; first connecting means for connecting the connecting bar to the pendulum bar; second connecting means for connecting the cable to the pendulum bar; and, releasable latching means for engaging the pendulum bar into the unlocked position from the force of gravity on the pendulum bar as the garage door is opened and the attaching member rotates from a vertical to a horizontal position thus holding the locking bolt in a retracted position and for holding the pendulum bar in the unlocked position and only releasing the pendulum bar to return to the locked position after the attaching member has returned to the vertical position.

In the preferred embodiment, the releasable latching means comprises, the side members each having a first slot and a second slot disposed opposite the first slot and the second slot of the other of the side members, the first slot being vertically higher at a top end thereof than the second slot, the second slot having a side slot communicating therewith at a top outer end thereof; the pendulum bar having first and second spaced bores therethrough adjacent an end thereof along a longitudinal line of the bar; a first pin disposed through the first bore and the first slot; and, a second pin disposed through the second bore and the second slot; and wherein additionally, spacing between the bores is slightly wider than spacing between the first slot and the second slot whereby the pendulum bar is disposed at the downward acute angle to the top panel whereby the second pin pivots about the first pin into the side slot from the force of gravity on the pendulum bar as the garage door is opened and the attaching member rotates from a vertical to a horizontal position thus holding the locking bolt in a retracted position until the second pin is released from the side slot upon the attaching member returning to the vertical position. Also, the first connecting means comprises means for connecting the connecting bar to the first pin and the second connecting means comprises means for connecting the cable to the first pin. Additionally, the pendulum bar is U-shaped to provide greater stability during movement of the pendulum bar between the side members and greater weight to the pendulum bar upon which gravity can act.

As an option, the pendulum bar is positioned to be contacted by the connecting bar as the garage door reaches a closed position whereby the connecting bar urges the second pin from the side slot to release the locking bolt.

DESCRIPTION OF THE PREFERRED EMBODIMENT

Figure 2:
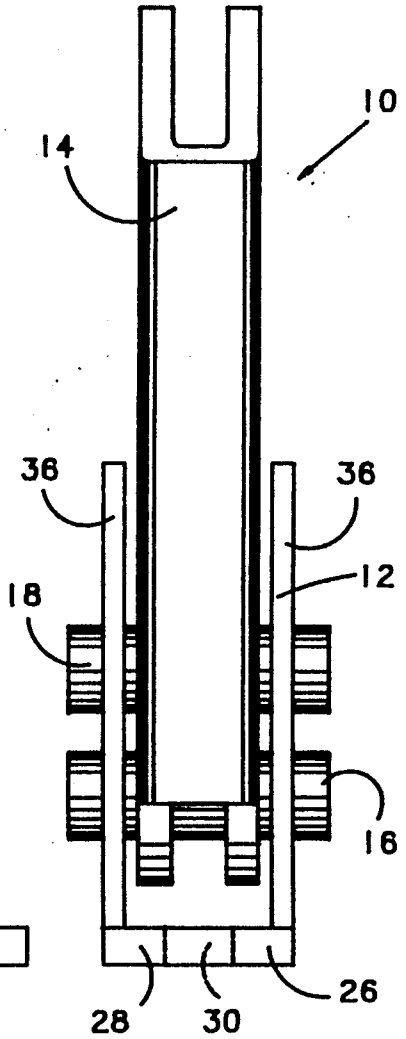
FIG. 2 is an end view of the mechanism of FIG. 1.
Figure 1:
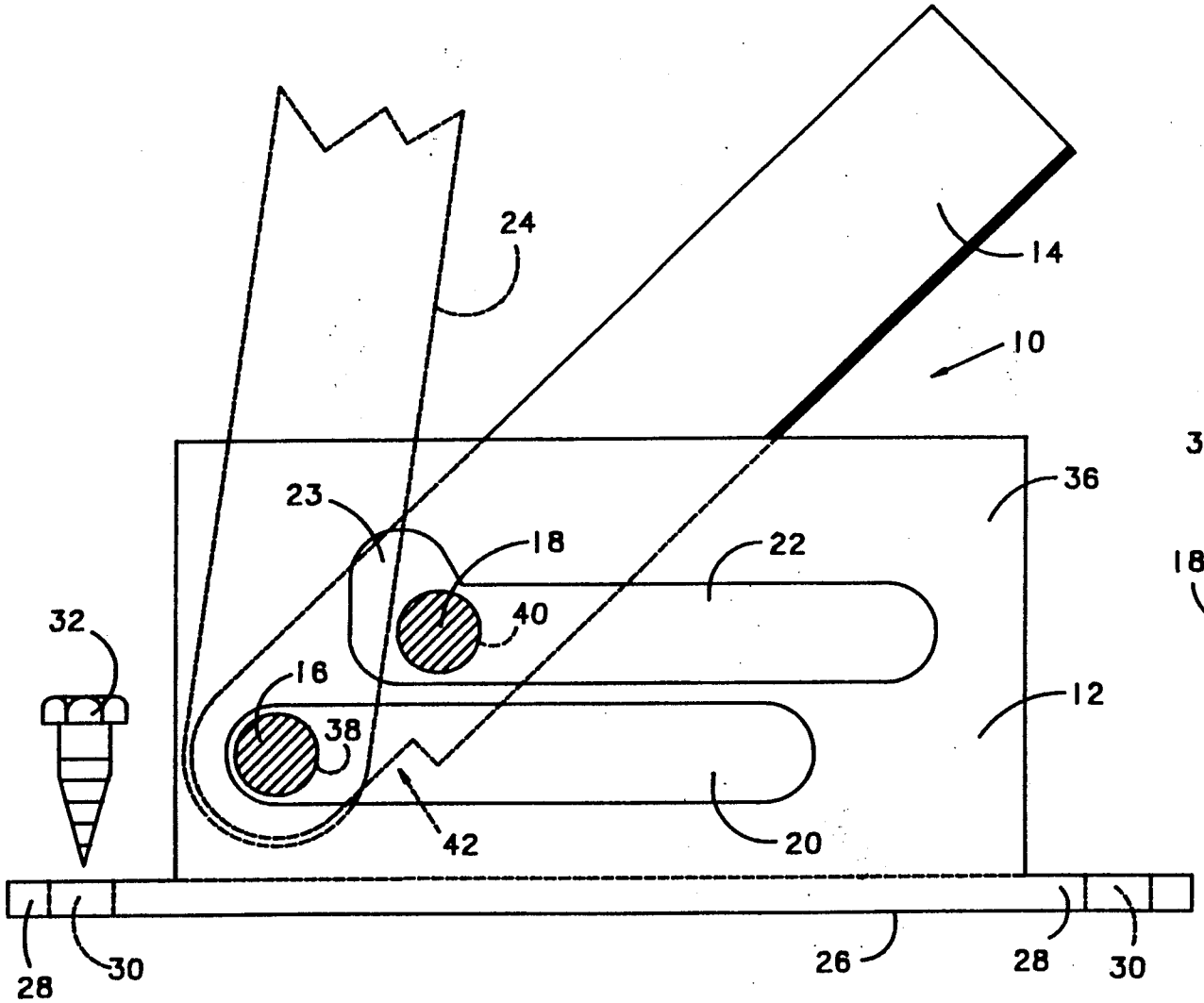
FIG. 1 is a side view of the garage door lock actuation mechanism of this invention.

The lock actuation mechanism of this invention is shown in detail in FIGS. 1 and 2 where it is generally indicated as 10. The mechanism 10 comprises a U-shaped attaching member 12 and a pendulum 14 mounted on pins 16, 18 for sliding movement within slots 20, 22, respectively. Bolts can be used for the pins 16, 18 or cylindrical pins held in place with cotter pins, or the like. The device used for the pins 16, 18 is a matter of choice and, therefore, in the interest of simplicity, the pins 16, 18 are merely shown as they pass through the pendulum 14 and the slots 20, 22. As shown by the dashed line 24, the typical J-bar from the automatic garage door opener (not shown) is pivotally connected to the pin 16 and clears the pin 18 during its movement.

The attaching member 12 comprises a back piece 26 having extension tabs 28 on the ends with holes 30 therethrough through which lag bolts 32, or the like, can be passed to attach the attaching member 12 to the top panel 34 of the garage door. A pair of spaced side members 36 having the slots 20, 22 therein extend outward from the back piece 26 to form the general U-shape of the attaching member 12. As shown in the drawings, the slots 20, 22 are parallel to one another and to the back piece 26. Additionally, the outer slot 22 (i.e. furthest from the top panel 34) is offset in what will be seen to be the downward and forward directions. The outer slot 22 also has a small connecting side slot 23 extending backward/downward in what will be seen to be its upper/back end. The pendulum 14 is also of similar U-shaped construction so as to provide stability for movement between the side members 36 and added weight so as to better perform it functions under the force of gravity as will be described shortly. The inner end of the pendulum 14 has a pair of bores 38, 40 therethrough through which the pins 16, 18 loosely fit for ease of movement. In the tested embodiment which was made as compact as possible, the portion of the inner end of the pendulum 14 adjacent the back piece 26 at 42 was removed to prevent its hitting and binding against the back piece 26.

Figure 4:
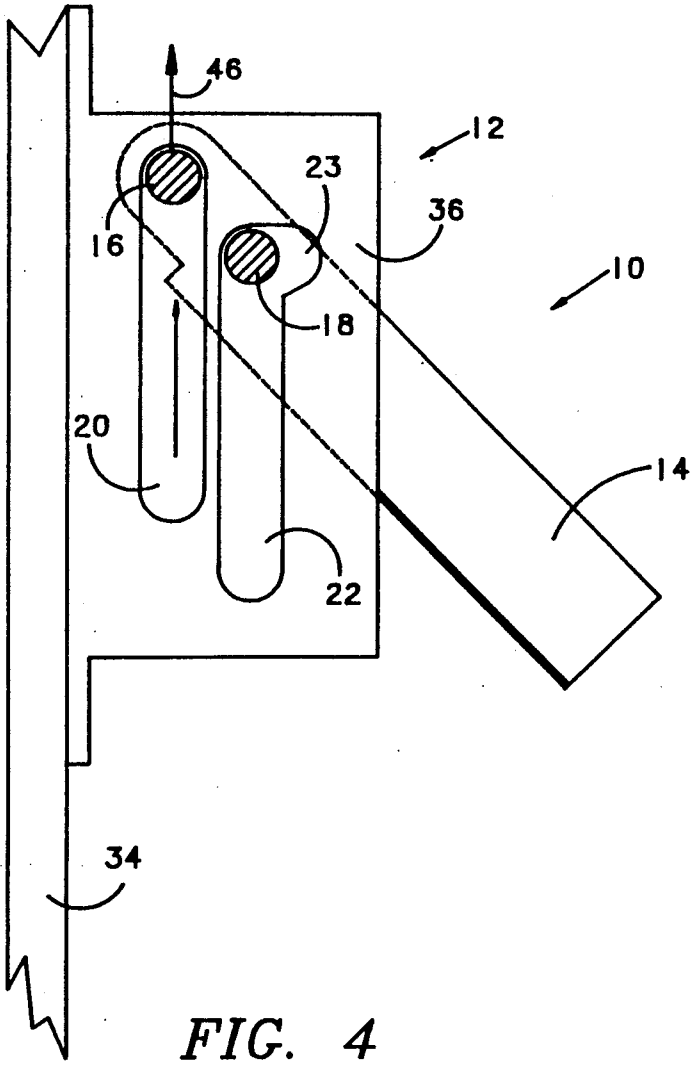
FIG. 4 is a side view of the mechanism when the door has been unlocked and just prior to being raised by the automatic opener connected to the mechanism.
Figure 3:
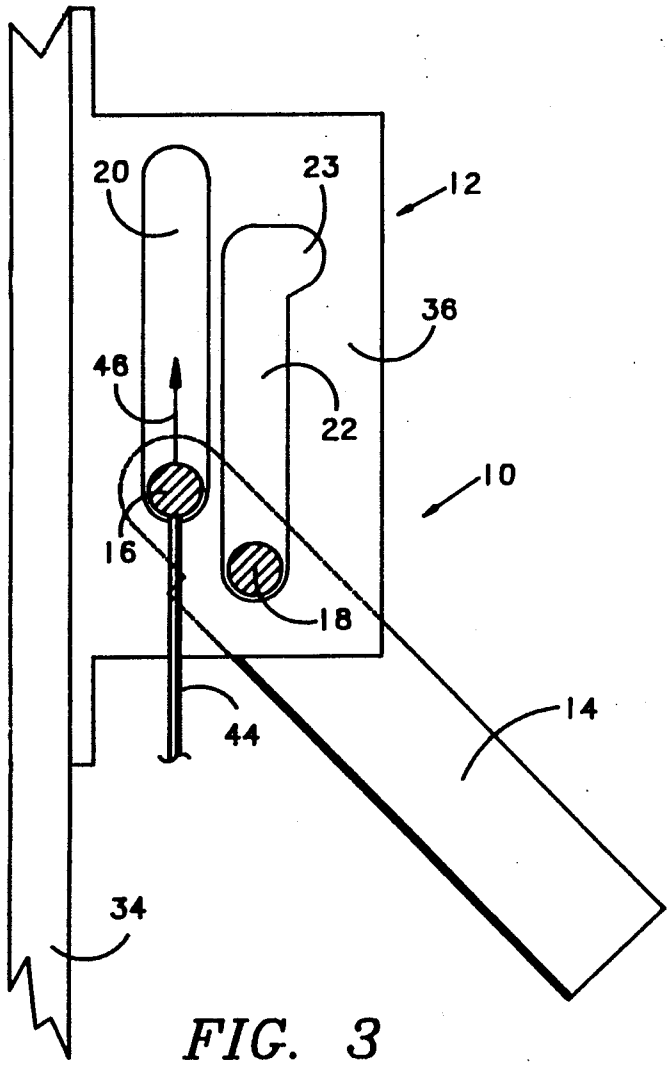
FIG. 3 is a side view of the mechanism as attached to the top of a rolling overhead garage door when the door is locked and prior to being raised by the automatic opener connected to the mechanism.

Turning now to the remaining drawing figures, the manner of operation of the mechanism will now be described in detail. In the interest of simplicity and the avoidance of confusion, the J-bar 24 of the door opener is not shown and only the forces created thereby are shown by way of force arrows. As shown in FIG. 3, the mechanism 10 is mounted on the top panel 34 with the side members 36 oriented vertically so that the pendulum 14 can slide up and down (and forward and back when the top panel 34 is horizontal). A connecting cable 44 is also connected to the pin 16 on one end in any manner which is convenient. The other end of the cable 44 is connected to retract the spring-loaded locking bolt(s) of the door (not shown for simplicity) in a manner suitable to the particular garage door and as well known to those skilled in the art in such installations. The cable 44 will also be replaced by force arrows in subsequent drawings in the interest of simplicity. As depicted in FIG. 3, the mechanism is in its "door locked" position. As the door opening mechanism starts to open the garage door, the J-bar lifts the pin 16 as indicated by the arrow 46. Before the top panel 34 (and door) moves, pin 16 is lifted to the end of its slot 20 as depicted in FIG. 4 thereby first withdrawing the locking bolt(s). Upon reaching the position of FIG. 4, pin 16 bears against the end of slot 20 and begins to lift the top panel 34. Pin 18, of course, moves in combination with pin 16; but, has no particular function at this point of the operation.

Figure 5:
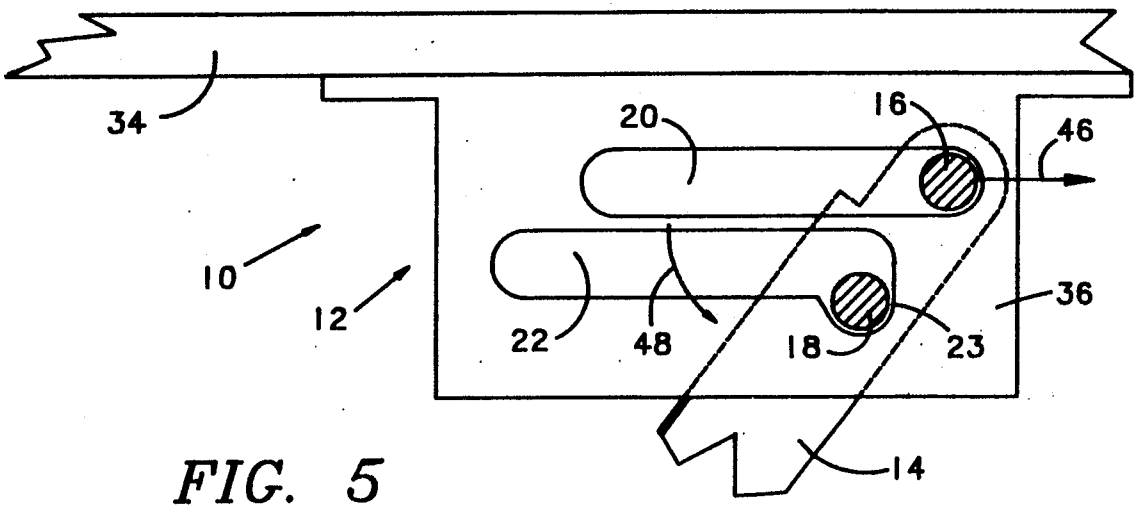
FIG. 5 is a side view of the mechanism when the door is being raised by the automatic opener connected to the mechanism as the top of the door and the mechanism move horizontally along the supporting track for the door towards the fully open position.

With pin 16 in the position of FIG. 4, as the mechanism 10 rotates from vertical to horizontal along with the top panel 34, the weight of the pendulum 14 causes the pendulum 14 to pivot slightly about pin 16 as depicted by the arrow 48 so that pin 18 enters the side slot 23 as depicted in FIG. 5, where it stays throughout the balance of the opening of the garage door.

Figure 6:
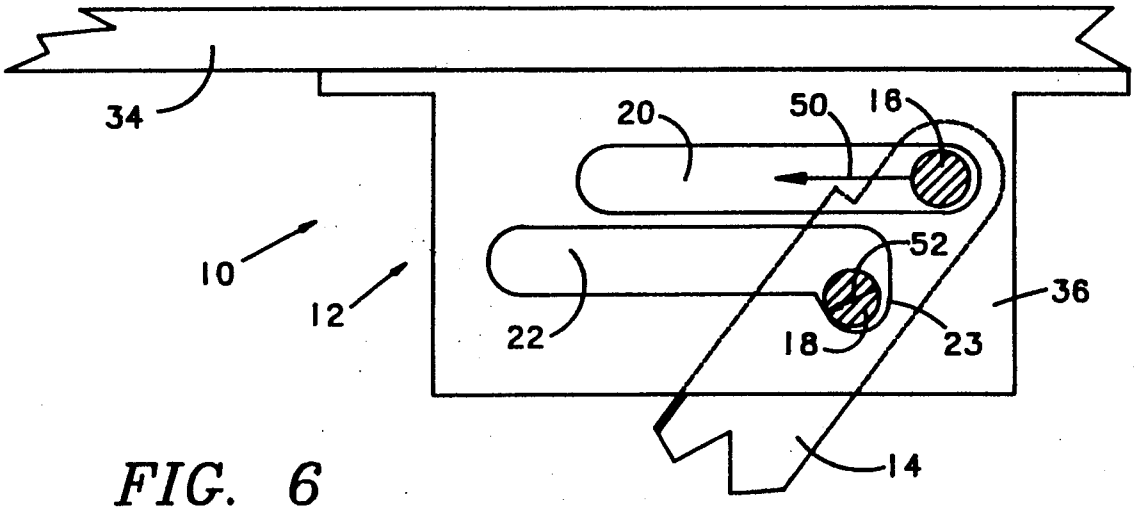
FIG. 6 is a side view of the mechanism when the door is being closed by the automatic opener connected to the mechanism as the top of the door and the mechanism move horizontally along the supporting track for the door from the fully open position towards the closed position.

When the automatic garage door mechanism begins to close the garage door, the J-bar pushes against pin 16 in the opposite direction as indicated by the arrow 50 in FIG. 6. The pins 16, 18 do not immediately slide in the opposite direction down their respective slots 20, 22 as they did in the opening operation because of the interaction of pin 18 with the side slot 23. The weight of the pendulum 14 is such that the force of gravity holds pin 18 against the side of the side slot 23 where it pushes against the sidewall of the side slot 23 as indicated by the arrow 52. Thus, the garage door is pushed towards its closed position with its locking bolt(s) held in a retracted position as desired.

Figure 7:
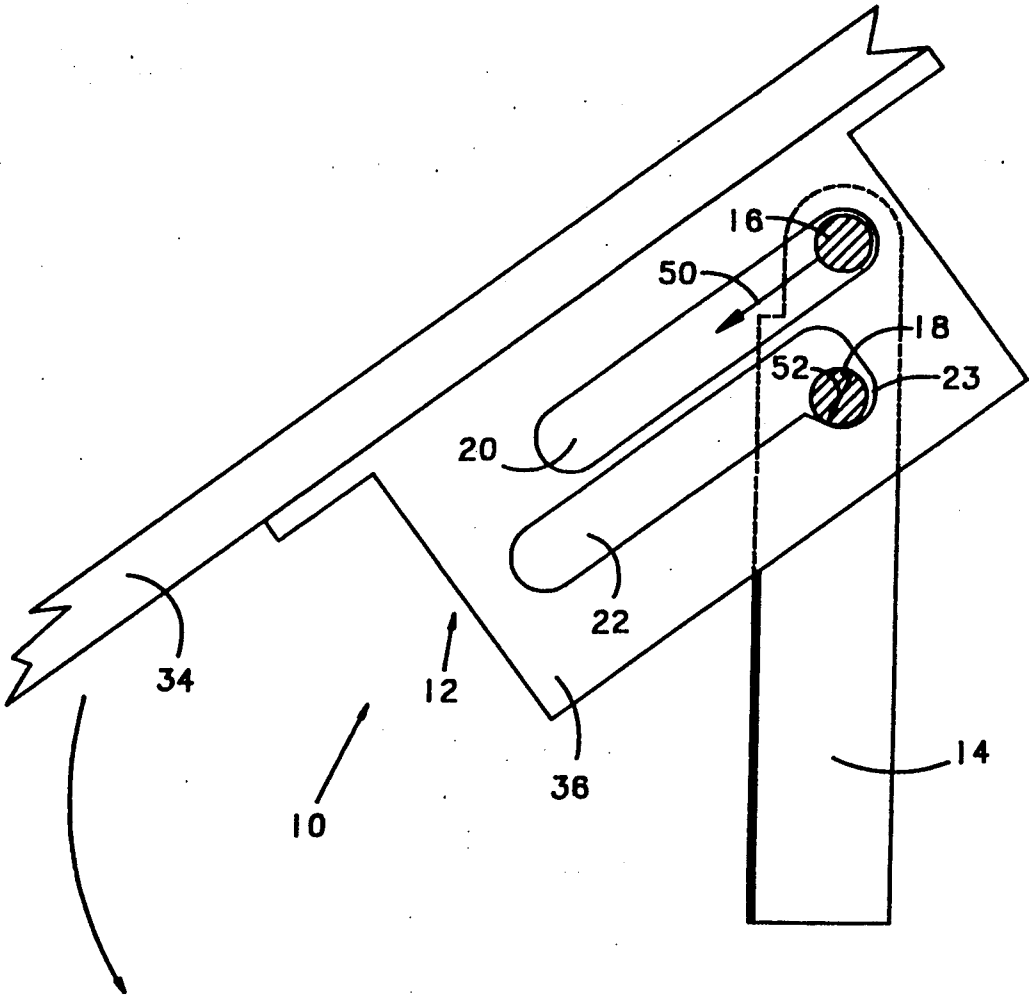
FIG. 7 is a side view of the mechanism when the door is being closed by the automatic opener connected to the mechanism as the top of the door and the mechanism rotate from a position moving horizontally along the supporting track for the door to a position moving vertically downward towards the closed position.

Generally, because of their weight, rolling overhead garage doors have one or more springs which support their weight positively so that there is a positive bias force in the raised direction. Thus, the closing force of the J-bar as indicated by the arrow 50 will continue to push against this biasing force throughout the closing procedure. Thus, as the mechanism 10 rotates from horizontal back to vertical as shown in FIG. 7, the force of gravity and the pushing force of the J-bar will generally continue to hold pin 18 against the side of the side slot 23 pushing against the sidewall of the side slot 23 as indicated by the arrow 52.

Figure 9:
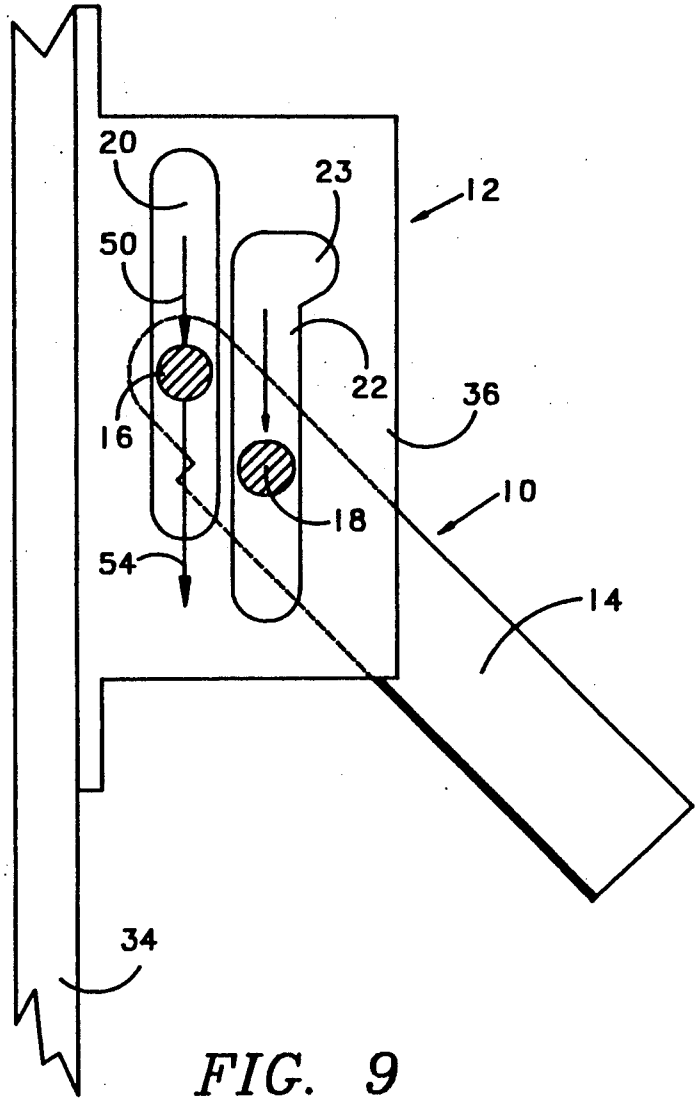
FIG. 9 is a side view of the mechanism when the door is being closed by the automatic opener connected to the mechanism as the mechanism moves downward after unlatching thereby allowing the door's locking mechanism to engage.
Figure 8:
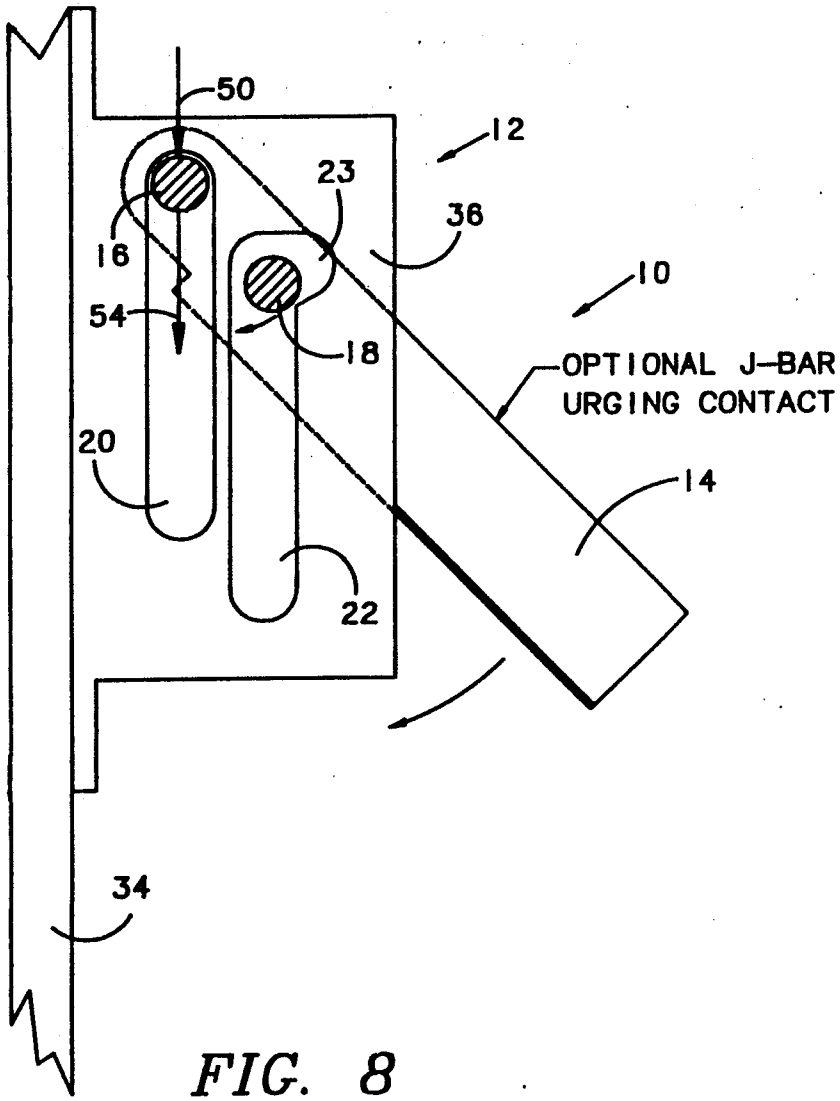
FIG. 8 is a side view of the mechanism when the door is being closed by the automatic opener connected to the mechanism as the mechanism approaches a vertical position and unlatches to allow the door's locking mechanism to engage.

As shown in FIG. 8, at some point in the travel of the mechanism downward in the vertical direction as the door closes, either gravity or an urging by a back portion of the J-bar, or both, will cause pin 18 to become disengaged from the side slot 23. At that point, the locked withdrawn position of the door locking bolt(s) is disengaged and pins 16 and 18 can move down the slots 20, 22 (as depicted in FIG. 9) to allow the connecting cable (arrow 54) and locking bolt(s) to move forward and engage the locking hole(s) provided therefor when the door reaches it fully closed position.

Wherefore, having thus described my invention, what is claimed is:

1. In a rolling overhead garage door having a plurality of horizontal, joined, articulated panels supported for vertical and horizontal movement between closed and open positions, a spring-loaded locking bolt withdrawable by a cable connected thereto, and an automatic opening and closing mechanism connected to a top panel of the door by a connecting bar, a door lock actuation mechanism which retains the locking bar in a retracted position for an optimum period of door travel away from the closed position comprising:

a) a U-shaped attaching member including means for attaching said attaching member to the top panel, said attaching member having a pair of vertical, parallel, spaced side members, said side members each having a first slot and a second slot disposed opposite said first slot and said second slot of the other of said side members, said first slot being vertically higher at a top end thereof than said second slot, said second slot having a side slot communicating therewith at a top outer end thereof;

b) a pendulum bar disposed between said side members and having first and second spaced bores therethrough adjacent an end thereof along a longitudinal line of said bar;

c) a first pin disposed through said first bore and said first slot; and, d) a second pin disposed through said second bore and said second slot; and wherein additionally, e) spacing between said bores is slightly wider than spacing between said first slot and said second slot whereby said pendulum bar is disposed at a downward acute angle to the top panel;

f) the connecting bar is pivotally connected to said first pin; and, g) the cable is connected to said first pin whereby said second pin pivots about said first pin into said side slot from the force of gravity on said pendulum bar as the garage door is opened and said attaching member rotates from a vertical to a horizontal position thus holding the locking bolt in a retracted position until said second pin is released from said side slot upon said attaching member returning to said vertical position.

2. The door lock actuation mechanism of claim 1 wherein:

said pendulum bar is U-shaped to provide greater stability during movement of said pendulum bar between said side members and greater weight to said pendulum bar upon which gravity can act.

3. The door lock actuation mechanism of claim 1 wherein:

said pendulum bar is positioned to be contacted by the connecting bar as the garage door reaches a closed position whereby the connecting bar urges said second pin from said side slot to release the locking bolt.

4. In a rolling overhead garage door having a plurality of horizontal, joined, articulated panels supported for vertical and horizontal movement between closed and open positions, a spring-loaded locking bolt withdrawable by a cable connected thereto, and an automatic opening and closing mechanism connected to a top panel of the door by a connecting bar, a door lock actuation mechanism which retains the locking bar in a retracted position for an optimum period of door travel away from the closed position comprising:

a) a U-shaped attaching member including means for attaching said attaching member to the top panel, said attaching member having a pair of vertical, parallel, spaced side members;

b) a pendulum bar disposed between said side members for sliding movement therebetween between a locked position and an unlocked position, said pendulum bar being disposed at a downward acute angle to the top panel;

c) first connecting means for connecting the connecting bar to said pendulum bar;

d) second connecting means for connecting the cable to said pendulum bar; and, e) releasable latching means for engaging said pendulum bar into said unlocked position from the force of gravity on said pendulum bar as the garage door is opened and said attaching member rotates from a vertical to a horizontal position thus holding the locking bolt in a retracted position and for holding said pendulum bar in said unlocked position and only releasing said pendulum bar to return to said locked position after said attaching member has returned to said vertical position.

5. The door lock actuation mechanism of claim 4 wherein said releasable latching means comprises:

a) said side members each having a first slot and a second slot disposed opposite said first slot and said second slot of the other of said side members, said first slot being vertically higher at a top end thereof than said second slot, said second slot having a side slot communicating therewith at a top outer end thereof;

b) said pendulum bar having first and second spaced bores therethrough adjacent an end thereof along a longitudinal line of said bar;

c) a first pin disposed through said first bore and said first slot; and, d) a second pin disposed through said second bore and said second slot; and wherein additionally, e) spacing between said bores is slightly wider than spacing between said first slot and said second slot whereby said pendulum bar is disposed at said downward acute angle to the top panel whereby said second pin pivots about said first pin into said side slot from the force of gravity on said pendulum bar as the garage door is opened and said attaching member rotates from a vertical to a horizontal position thus holding the locking bolt in a retracted position until said second pin is released from said side slot upon said attaching member returning to said vertical position.

6. The door lock actuation mechanism of claim 4 wherein:

said first connecting means comprises means for connecting the connecting bar to said first pin.

7. The door lock actuation mechanism of claim 4 wherein:

said second connecting means comprises means for connecting the cable to said first pin

8. The door lock actuation mechanism of claim 4 wherein:

said pendulum bar is U-shaped to provide greater stability during movement of said pendulum bar between said side members and greater weight to said pendulum bar upon which gravity can act.

9. The door lock actuation mechanism of claim 5 wherein:

said pendulum bar is positioned to be contacted by the connecting bar as the garage door reaches a closed position whereby the connecting bar urges said second pin from said side slot to release the locking bolt.

10. In a rolling overhead garage door having a plurality of horizontal, joined, articulated panels supported for vertical and horizontal movement between closed and open positions, a spring-loaded locking bolt withdrawable by a cable connected thereto, and an automatic opening and closing mechanism connected to a top panel of the door by a connecting bar, a method of constructing and operating a door lock actuation mechanism so as to retain the locking bar in a retracted position for an optimum period of door travel away from the closed position comprising the steps of:

a) prior to use, a1) attaching a U-shaped attaching member having a pair of vertical, parallel, spaced side members to the top panel, a2) disposing a pendulum bar between the side members at a downward acute angle to the top panel for sliding movement therebetween a locked position and an unlocked position, a3) connecting the connecting bar to the pendulum bar, and a4) connecting the cable to the pendulum bar; and, b) at time of use, b1) engaging the pendulum bar into the unlocked position from the force of gravity on the pendulum bar as the garage door is opened and the attaching member rotates from a vertical to a horizontal position thus holding the locking bolt in a retracted position, and b2) holding the pendulum bar in the unlocked position and only releasing the pendulum bar to return to the locked position after the attaching member has returned to the vertical position.

11. The method of claim 10 wherein the steps thereof include the steps of:

a) including within each of the side members a first slot and a second slot disposed opposite the first slot and the second slot of the other of the side members with the first slot being vertically higher at a top end thereof than the second slot and the second slot having a side slot communicating therewith at a top outer end thereof;

b) including first and second spaced bores through the pendulum bar adjacent an end thereof along a longitudinal line of the bar;

c) disposing a first pin through the first bore and the first slot;

d) disposing a second pin disposed through the second bore and the second slot; and, e) making the spacing between the bores slightly wider than spacing between the first slot and the second slot whereby the pendulum bar is disposed at the downward acute angle to the top panel whereby said steps (b1) and (b2) comprise the second pin pivoting about the first pin into the side slot from the force of gravity on the pendulum bar as the garage door is opened and the attaching member rotates from a vertical to a horizontal position and holding the locking bolt in a retracted position until the second pin rotates from the side slot upon the attaching member returning to the vertical position.

12. The method of claim 11 and additionally including the step of:

positioning the pendulum bar to be contacted by the connecting bar as the garage door reaches a closed position whereby the connecting bar urges the second pin from the side slot to release the locking bolt.

* * * * *